United States Patent [19]

Yamaguchi

[11] Patent Number: 4,924,542

[45] Date of Patent: May 15, 1990

[54] SLEEPING MATTRESS

[75] Inventor: Tomoyoshi Yamaguchi, Tokyo, Japan

[73] Assignee: Japan Life Company, Ltd., Tokyo, Japan

[21] Appl. No.: 347,687

[22] Filed: May 5, 1989

[30] Foreign Application Priority Data

Mar. 24, 1989 [JP] Japan ..... 1-72372

[51] Int. Cl.[5] ..... A47C 27/22

[52] U.S. Cl. ..... 5/481; 5/448

[58] Field of Search ..... 5/446–448, 5/462, 464, 481; 600/9

[56] References Cited

U.S. PATENT DOCUMENTS

| | | | |
|---|---|---|---|
| 3,940,811 | 3/1976 | Tomikawa et al. | 5/481 |
| 4,143,435 | 3/1979 | Masuda | 5/481 |
| 4,161,045 | 7/1979 | Regan | 5/481 X |
| 4,330,892 | 3/1982 | Fukushima | 5/462 X |
| 4,509,219 | 4/1985 | Yagi | 5/481 |
| 4,574,911 | 3/1986 | Yogi | 5/447 X |

*Primary Examiner*—Michael F. Trettel

*Attorney, Agent, or Firm*—Browdy and Neimark

[57] ABSTRACT

The present invention provides a sleeping mattress comprising:

an upper cushion member provided with a plurality of undulated projections and a plurality of through-holes;

a core member which is disposed under said upper cushion member while provided with a plurality of concave portions serving as reinforcing ribs together with a plurality of semi-spherical elements received in said through-holes of said upper cushion member, said semi-spherical elements being provided in an upper surface of said core member; and a lower cushion member a peripheral edge portion of which is fixed to a peripheral edge portion of said upper cushion member so that said core member is interposed between said upper cushion member and said lower cushion member.

The reinforcing ribs are formed in the core member when the core member is produce through a compression molding process. The ribs serve to hold the shape of the sleeping mattress. The semi-spherical elements: are received in the through-holes of the upper cushion member; project therefrom upward; and abut on the user's body directly or through a thin cover; to enable the user to enjoy a sufficient magnetic curing effect and a healing pressure like finger pressure applied to acupuncture points of the user's body.

5 Claims, 3 Drawing Sheets

SLEEPING MATTRESS

BACKGROUND OF THE INVENTION

1. Field of the Invention

The present invention relates to a sleeping mattress, and more particularly to a sleeping mattress provided with a hard core member therein together with a plurality of permanent magnets disposed in a body-supporting surface of the sleeping mattress.

2. Description of the Prior Art

A sleeping mattress of this kind is disclosed, for example, in U.S. Pat. No. 4,509,219. In such a conventional sleeping mattress, a plurality of semi-spherical projections are formed in a surface of a board-like fiber layer which is a compression layer of fibers such as natural vegetable fibers like palm fibers or of fibers such as synthetic fibers, in a top concave portion of each of which projections a small magnet piece is embedded. These semi-spherical projections are covered with a sheet made of suitable materials such as urethane foam and the like. On the other hand, a structural frame constructed of flexible wires such as steel wires is provided inside the above fiber layer to form a core member of the sleeping mattress.

However, the core member of the above conventional sleeping mattress is cumbersome in assembling of the sleeping mattress because, in order to hold the shape of the sleeping mattress well, the structural frame constructed of the flexible wires such as steel wires must be inserted into the compression fiber layer. In addition, such structural frame increases material cost as well as production cost in manufacturing thereof, and also considerably increases the weight of the sleeping mattress to impair easiness in use thereof. Further, due to the presence of such structural frame, the magnetic effect of the permanent magnets of the conventional sleeping mattress does not serve well at deeper parts of the user's body.

SUMMARY OF THE INVENTION

It is an object of the present invention to provide a sleeping mattress which can hold well its shape without employing any structural frame constructed of flexible wires such as steel wires.

It is another object of the present invention to provide a sleeping mattress which is easily produced and therefore sufficiently low in production cost while being relatively small in weight and therefore excellent in easiness in use.

It is further another object of the present invention to provide a sleeping mattress which enables the user to assume a comfortable posture during sleeping, through which the user enjoys a sufficient magnetic curing effect and a healing pressure like a finger pressure applied to acupuncture points of the user's body so that the blood is smoothly circulated through the user's body to make his sleep deeper and enhance his health.

The above objects of the present invention are accomplished by providing:

A sleeping mattress comprising:

an upper cushion member provided with a plurality of undulated projections and a plurality of through-holes;

a core member which is disposed under said upper cushion member while provided with a plurality of concave portions serving as reinforcing ribs together with a plurality of semi-spherical elements received in said through-holes of said upper cushion member, said semi-spherical elements being provided in an upper surface of said core member; and a lower cushion member a peripheral edge portion of which is fixed to a peripheral edge portion of said upper cushion member so that said core member is interposed between said upper cushion member and said lower cushion member.

Other and further objects, features and advantages of the present invention will appear more fully from the following description.

DESCRIPTION OF THE PREFERRED EMBODIMENTS

The more preferable embodiment of the present invention will be described in detail with reference to the accompanying drawings.

Figure 1:
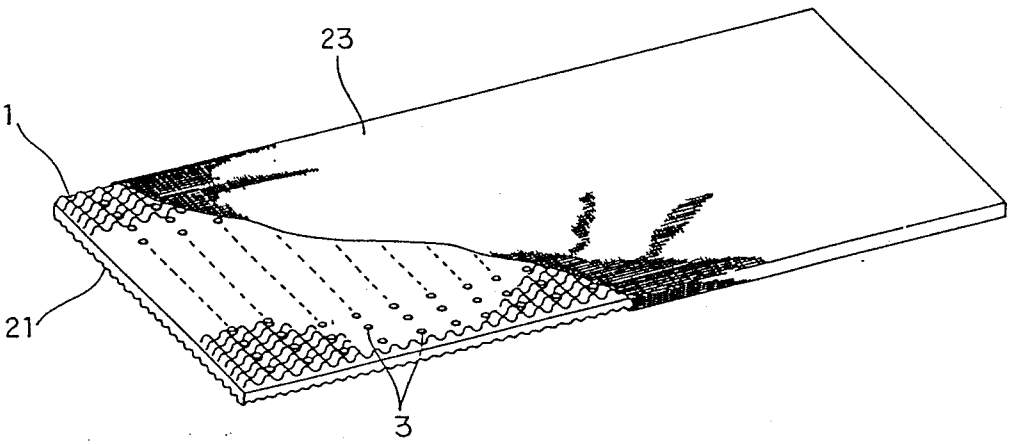
FIG. 1 is a perspective view of the sleeping mattress of the present invention.
Figure 2:
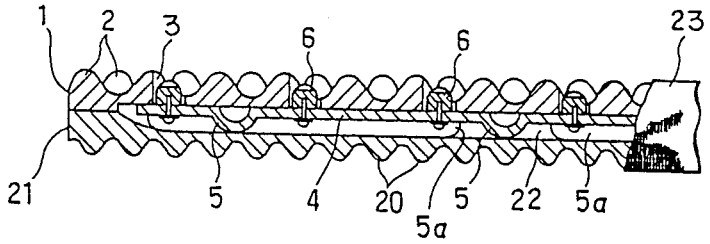
FIG. 2 is a longitudinal sectional view of the sleeping mattress of the present invention for illustrating the construction thereof.
Figure 3:
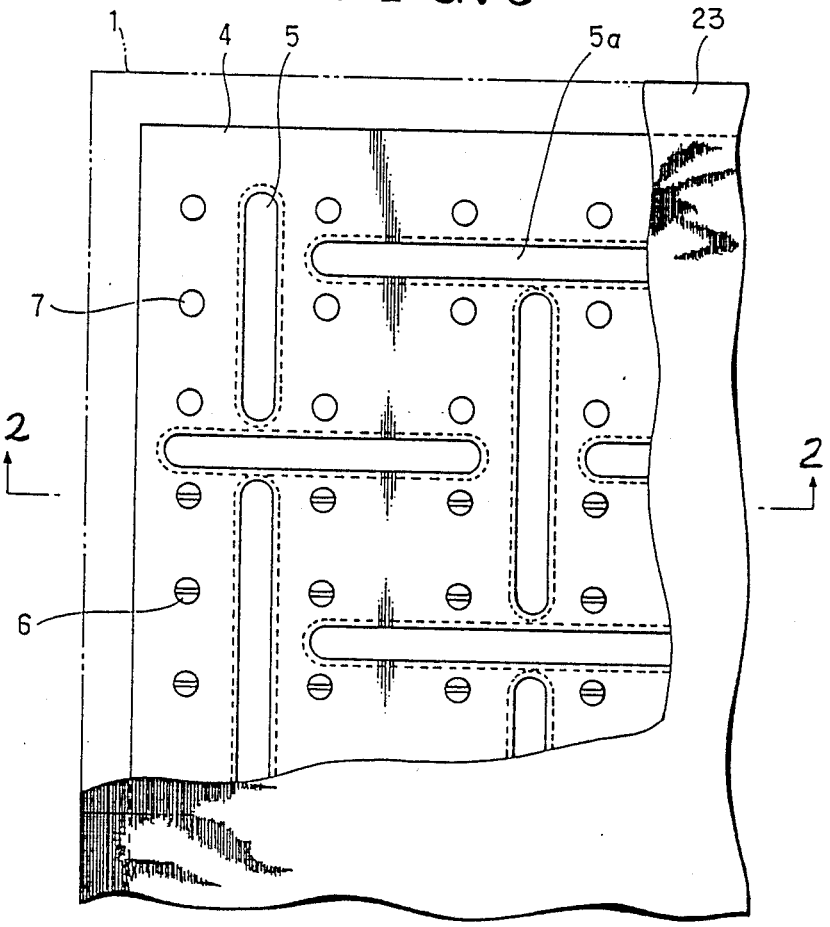
FIG. 3 is a plan view of the sleeping mattress of the present invention after the upper cushion member is removed.
Figures 4A, 4B, 4C, 4D:
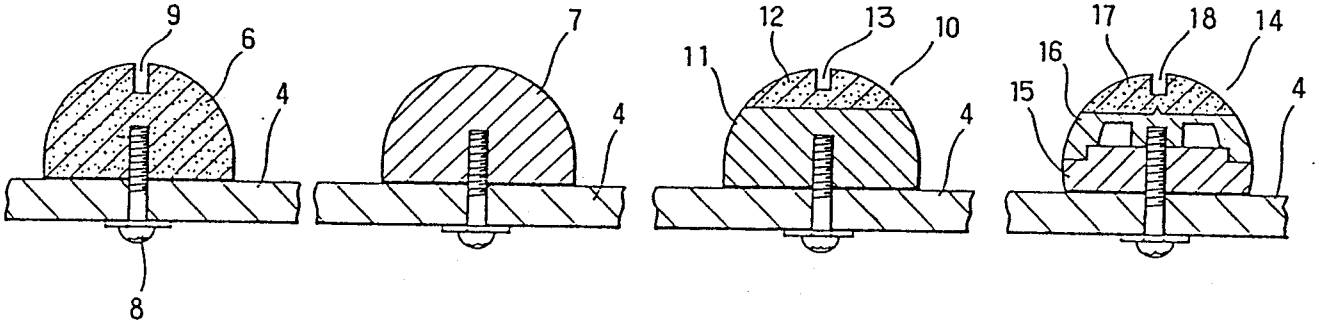
FIGS. 4 (A)–(D) are longitudinal sectional views of the semi-spherical elements of the sleeping mattress of the present invention.

In the drawings, the reference numeral 1 denotes an upper cushion member made of a suitable material such as urethane foam, in which member 1 a plurality of undulated projections 2 are formed. The undulated projections 2 are so arranged lengthwise and crosswise as to assume a staggered arrangement in which the projections 2 are spaced apart from each other. The upper cushion member 1 is also provided with a plurality of through-holes 3 which pass vertically through the upper cushion member 1. A surface of the upper cushion member 1 is impregnated with resin liquid such as urethane so as to be strengthened. The reference numeral 4 denotes a core member made of compressed vegetable fibers such as palm fibers and the like. The core member 4 is formed into a board-like shape with the use of adhesives so that it is moderate in stiffness and excellent in air-permeability. It is also possible to form the core member 4 from other materials such as cork boards, plywood and plastics. The core member 4 is provided with a plurality of reinforcing ribs 5, 5*a* each of which is formed from an elongated concave portion of the core member 4 and extends in a longitudinal direction or in a transverse direction of the core member 4 so as to be arranged in a staggered manner with each other. The longitudinally-extending concave portion of the core member 4 constitutes a longitudinal reinforcing rib 5 for reinforcing in stiffness the core member 4 lengthwise. On the other hand, the transversely-extending concave portion of the core member 4 constitutes a transverse reinforcing rib 5*a* for reinforcing in stiffness the core member 4 transversely. As shown in FIG. 3, these reinforcing ribs 5, 5*a* are so arranged as to assume a staggered arrangement while spaced apart from each other. If necessary, in addition to these reinforcing ribs 5, 5*a*, it is also possible to provide in the core member 4 a plurality of oblique reinforcing ribs (not shown) for reinforcing in stiffness the core member 4 obliquely. The core member 4 may have a plurality of thin-wall portions extending transversely the whole width of the core member 4. In case that the number of the thin-wall portions of the core member 4 is two, it is possible to fold the core member 4 in thirds. In an upper surface of the core member 4 are fixedly mounted: a plurality of permanent magnets 6; and a plurality of pressing projections 7 for applying healing pressure like finger pressure to the user's body. FIGS. 4 (A)–(D) illustrate embodiments of such permanent magnets 6 and the pressing projections 7. Shown in FIG. 4 (A) is a semi-spherical permanent magnet 6 which is directly mounted on the core member 4 by means of a suitable fastening means such as a screw 8. In FIG. 4 (A), preferably, N and S poles of the permanent magnet 6 are positioned in an upper surface of the magnet 6 while spaced apart from each other through a groove 9 which permits the lines of magnetic force to leach a distant place. Consequently, in case that the permanent magnet 6 is so employed as to abut on the user's body, the lines of magnetic force may reach the deeper parts of the user's body to enable him to enjoy a sufficient magnetic curing effect. In the permanent magnet 6, it is naturally possible to eliminate the groove 9. The permanent magnet 6 is usually made of sintered ferrite alloys. However, it is also possible that the permanent magnet 6 is made of magnetic plastics which is light in weight and excellent in feeling. Shown in FIG. 4 (B) is a semi-spherical pressing projection 7 which is fixedly mounted on the core member 4 in the same manner as that of the permanent magnet 6. The pressing projection 7 is made of a suitable materials such as plastics, hard rubber, wood, cork and the like. Shown in FIG. 4 (C) is a skid-mounted or space mounted permanent magnet assembly 10 in which a skid 11 assumes a truncated semi-spherical form. The skid 11 is made of the same material as that of the pressing projection 7. Mounted on a top portion of the truncated semi-spherical skid or spacer 11 is a permanent magnet 12 assuming the same form as that of a top portion of the semi-spherical form. The skid-mounted permanent magnet assembly 10 is also fixedly mounted on the core member 4 in the same manner as that of the permanent magnet 6. The skid-mounted permanent magnet 12 is preferably provided with a groove 13 as is in the case of the permanent magnet 6. Shown in FIG. 4 (D) is a cushion-mounted permanent magnet assembly 14 in which a permanent magnet 17 is directly mounted on a damper or cushion 15, preferably through a mount 16. The damper or cushion 15 is made of urethane resins, styrene resins, rubber and the like. As is clear from FIG. 4 (D), the cushion-mounted permanent magnet assembly 14 assumes a semi-spherical shape as a whole. The mount 16 of the cushion-mounted permanent magnet assembly 14 is a substantially hollow member which is, for example, provided with: a ceiling portion; a screw-holding portion integrally connected with the ceiling portion; and a plurality of supporting leg portions each of which is integrally connected with the ceiling portion and has the same curvature in its outer surface as that of the outer surface of the permanent magnet 7. The mount 16 also serves as a cushion. Preferably, the permanent magnet 17 is also provided with a groove 18 as shown in FIG. 4 (D).

The above-mentioned permanent magnets 6, pressing projections 7, skid-mounted permanent magnet assemblies 10 and the cushion-mounted permanent magnet assemblies 14 are: adequately combined with each other; regularly distributed over the upper surface of the core member 4; and covered with a suitable sheet made of urethane resins and the like. The permanent magnets 6 and like projections of the core member 4 are received in the through-holes 3 of the upper cushion member 1 when the core member 4 is covered with the upper cushion member 1. On the other hand, a lower cushion member 21 provided with a plurality of undulated projections 20 in its lower surface is disposed under the core member 4. A peripheral edge portion of the lower cushion member 21 is fixed to that of the upper cushion member 1 with the use of a suitable adhesive. Incidentally, due to the presence of the reinforcing ribs 5, 5*a* in the core member 4, a clearance 22 is produced between the core member 4 and the lower cushion member 20. It is possible to fill the clearance 22 with a suitable padding materials such as urethane foam, sheet-like pad and the like. Incidentally, the reference numeral 23 denotes a cover of the sleeping mattress.

In use, when the user lies on the sleeping mattress of the present invention having the above construction, the user's body is brought into contact with the plurality of the undulated projections 2 of the upper cushion member 1 so that these undulated projections 2 is compressed to permit the user's body to abut on the semi-spherical elements such as the permanent magnets 6 and the like. Consequently, it is possible for the user during sleeping to enjoy a sufficient magnetic curing effect brought about by the permanent magnets 6 and the like, and also enjoy a healing pressure like finger pressure applied to acupuncture points of the user's body, so that circulation of blood through the user's body is enhanced to realize a deeper sleep through which the user may sufficiently recover himself. The core member 4 prevents the user's body to sink in the sleeping mattress irregularly so that it is possible for the user to assume a right posture during sleeping, through which the back bone of the user is stretched to remove any distortion of the user's body. The semi-spherical elements of the core member 4 effectively apply a healing pressure like finger pressure to acupuncture points of the user's body. In this case, since the plurality of the undulated projections 2 are interposed between these semi-spherical elements, there is no fear that the user's body is subjected to an excessive pressure. Such moderate healing pressure applied to the user's body by the semi-spherical elements may give the user a moderate stimulation and a good feeling to realize his deeper sleep. Naturally, the sleeping mattress of the present invention is moderate in resiliency, since the core member 4 is interposed between the upper and lower cushion members.

What is claimed is:

1. A sleeping mattress comprising:

an upper cushion member provided with a plurality of undulated projections and a plurality of through-holes;

a core member which is disposed under said upper cushion member while provided with a plurality of concave portions serving as reinforcing ribs together with a plurality of semi-spherical elements received in said through-holes of said upper cushion member, said semi-spherical elements being provided on an upper surface of said core member; and a lower cushion member a peripheral edge portion of which is fixed to a peripheral edge portion of said upper cushion member so that said core member is interposed between said upper cushion member and said lower cushion member.

2. The sleeping mattress as set forth in claim 1, wherein:

each of said semi-spherical elements is selected from the group comprising: a permanent magnet; a pressing projection having no magnet; a spacer-mounted permanent magnet assembly in an upper portion of which a permanent magnet is disposed; and a cushion-mounted permanent magnet assembly in which a permanent magnet is mounted on a cushion through a mount; and at least one of said semi-spherical elements is fixedly mounted on said core member.

3. The sleeping mattress as set forth in claim 2 wherein each of said semi-spherical elements is mounted to said core member by means of a fastener which extends through said core member.

4. The sleeping mattress as set forth in claim 3 wherein said fastener is a threaded screw.

5. The sleeping mattress as set forth in claim 4 wherein said threaded screw is inserted into said spherical element.

* * * * *